United States Patent [19]

Dekker et al.

[11] Patent Number: 4,661,267

[45] Date of Patent: Apr. 28, 1987

[54] FABRIC SOFTENER COMPOSITION

[75] Inventors: Bob Dekker, Strombeek-Bever; Axel König, Wemmel; Theodericus J. Straathof, Meise, all of Belgium; Eugene P. Gosselink, Cincinnati, Ohio

[73] Assignee: The Procter & Gamble Company, Cincinnati, Ohio

[21] Appl. No.: 789,054

[22] Filed: Oct. 18, 1985

[51] Int. Cl.[4] ..... D06M 11/00

[52] U.S. Cl. ..... 252/8.8; 252/8.75; 252/8.9

[58] Field of Search ..... 252/8.75, 8.8, 8.9

[56] References Cited

U.S. PATENT DOCUMENTS

| | | | |
|---|---|---|---|
| 3,416,952 | 2/1968 | McIntyre et al. | 117/118 |
| 3,512,920 | 5/1970 | Dunlop | 8/115.7 |
| 3,686,025 | 8/1972 | Morton | 252/8.8 |
| 3,712,873 | 1/1973 | Zenk | 260/29.2 E |
| 3,893,929 | 7/1975 | Basadur | 252/8.6 |
| 3,920,561 | 11/1975 | Des Marais | 252/8.8 |
| 3,928,213 | 12/1975 | Temple | 252/8.8 |
| 3,959,230 | 5/1976 | Hays | 252/8.9 |
| 4,136,038 | 1/1979 | Pracht et al. | 252/8.8 |
| 4,427,557 | 2/1984 | Stockburger | 252/8.7 |

FOREIGN PATENT DOCUMENTS

| | | |
|---|---|---|
| 1100262 | 5/1981 | Canada . |
| 58-163781 | 9/1983 | Japan . |
| 59-30967 | 2/1984 | Japan . |
| 1088984 | 10/1967 | United Kingdom . |
| 1175207 | 12/1969 | United Kingdom . |

*Primary Examiner*—Paul Lieberman
*Assistant Examiner*—Willie J. Thompson
*Attorney, Agent, or Firm*—Eric W. Guttag; Jack D. Schaeffer; Steven J. Goldstein

[57] ABSTRACT

Rinse-added fabric softening compositions containing a fabric softening active system at least 10% of which consists of certain di(higher alkyl) cyclic amines, and relatively low concentrations of polymeric soil release agents such as hydroxyether cellulosic polymers, copolymeric blocks of terephthalate and ethylene oxide or propylene oxide and cationic guar gums.

11 Claims, No Drawings

FABRIC SOFTENER COMPOSITION

TECHNICAL FIELD

The present invention relates to a fabric softening composition. More specifically, the invention relates to a rinse-added fabric softening composition containing a small but effective amount of a soil release agent.

Various high molecular weight polymers have been suggested for use as soil release agents in laundry detergent compositions. During the laundering operation, these polymers absorb onto the surface of fabric immersed in the wash solution. The absorbed polymer forms a hydrophilic film which remains on the fabric after it is removed from the wash solution and dried, thereby imparting soil release properties to the laundered fabric.

Rinse-added fabric softener compositions comprising a soil release agent have also been described. Typically, art-disclosed compositions comprise a quaternary ammonium compound as a fabric softening agent, and up to 10% of a soil release agent.

U.S. Pat. No. 4,136,038 granted Jan. 23, 1979 to Pracht et al., for example, discloses fabric softener compositions comprising from 1% to 30% of a water-insoluble organic fabric softener compound (e.g., a quaternary ammonium salt), and from 0.1% to 10% of a methyl cellulose ether soil release agent.

Canadian Pat. No. 1,100,262 granted May 5, 1981 to Becker et al describes fabric softening compositions comprising 1–80% of a quaternary ammonium compound, 0.5–25% of a certain choline ester salt and (optionally) 0.5–10% of a soil release agent. The preferred soil release agent is a copolymer of polyethylene terephthalate and polyoxyethyleneglycol.

It has now been discovered that soil release agent-containing fabric softener compositions formulated in accordance with the art can adversely affect the whiteness of cotton fabrics treated therewith, particularly upon repeated usage. It has further been discovered that such adverse effects on whiteness can be reduced, or even eliminated, by using the soil release agent at a low level. However, the soil release benefit is likewise reduced or eliminated at these lower concentrations of soil release agents.

It is an object of the present invention to provide a fabric softening composition comprising a soil release agent which avoids or reduces adverse effects on fabric whiteness, yet provides a significant soil release benefit.

SUMMARY OF THE INVENTION

The present invention relates to an aqueous fabric softener composition comprising:

(A) from 1% to 50% by weight of the composition of a fabric softening active system wherein at least 10% of said system is selected from the group consisting of the di(higher alkyl)cyclic amines of the formula

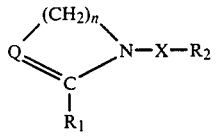

wherein n is 2 or 3, $R_1$ and $R_2$ are each selected from the group consisting of alkyl and alkenyl containing from 8 to 30 carbon atoms and mixtures thereof, Q is CH or N, X is $R_4$ or $$-R_4-T-\underset{\underset{O}{\|}}{C}-$$

wherein $R_4$ is an alkylene group containing from 1 to 3 carbon atoms or is $(C_2H_4O)_m$, m being an integer from 1 to 8, and T is O or $NR_5$, $R_5$ being H or alkyl having 1 to 4 carbon atoms; and (B) from 3% to 20% by weight of (A) of a soil release agent.

DETAILED DESCRIPTION OF THE INVENTION

The fabric softening compositions herein are based on the discovery that (a) low levels of soil release agent are necessary to avoid whiteness negatives, and (b) the presence of a di(higher alkyl) cyclic amine of formula (I) herein enhances the soil release benefit obtained with such a low level of soil release agent.

Hence, the compositions herein contain a low level of soil release agent and a softener active system at least part of which is an amine of formula (I).

The softener active system comprises from 1% to 50%, preferably from 3% to 35% of the total composition. At least 10% of the softener active system is a di(higher alkyl) cyclic amine selected from those of formula (I). Preferably, at least 30% of the softener active system is such an amine. The entire softener active system may be comprised of such amines, but preferably the system contains from 10% to 90%, more preferably from 20% to 50%, of one or more conventional fabric softening agents. For proper dispersion of the amine it is desirable (and, when no other softening agents are present, even necessary) to formulate the compositions herein in the pH range of from 2 to 6.5, preferably from 3 to 5.

The amount of soil release agent is related to the amount of softener active system in the composition. It has been found that compositions containing from 3% to 20%, preferably from 5% to 15%, by weight of the fabric softening active system, of soil release agent are suitable.

Thus, by way of example, a composition comprising 10% softener active material can contain from 0.3% to 2%, preferably from 0.8% to 1.5% (by weight of the composition) of the soil release agent. Similarly, a composition having 40% softener active material can contain from 1.2% to 6%, preferably from 3.2% to 6% by weight of the composition, of the soil release agent.

A. The Softener Active System

As described hereinabove, the softener active system comprises (by weight of the active system) from 10% to 100% of a specified amine and from 0% to 90% of one or more conventional fabric softening compounds such as quaternary ammonium salts and certain silicones.

(a) The Amine

The cyclic amines used in the compositions of the present invention are selected from the group consisting of compounds of the formula.

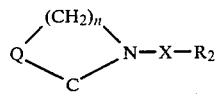

Formula (I)

wherein n is 2 or 3, preferably 2; $R_1$ and $R_2$ are, independently, a $C_8$–$C_{30}$ alkyl or alkenyl, preferably $C_{11}$–$C_{22}$ alkyl, more preferably $C_{15}$–$C_{18}$ alkyl, or mixtures of such alkyl radicals. Examples of such mixtures are the alkyl radicals obtained from coconut oil, "soft" (non-hardened) tallow, and hardened tallow. Q is CH or N, preferably N,

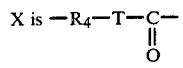

wherein T is O or $NR_5$, $R_5$ being H or $C_1$–$C_4$ alkyl, preferably H, and $R_4$ is a divalent $C_1$–$C_3$ alkylene group or $(C_2H_4O)_m$, wherein m is a number of from 1 to 8; or X is $R_4$.

Specific examples of such amines are as follows:

1-tallowamidoethyl-2-tallowimidazoline 1-(2-$C_{14}$–$C_{18}$-alkyl-amidoethyl)-2-$C_{13}$–$C_{17}$-alkyl-4,5-dihydro-imidazoline 1-stearylamidopropyl-2-stearylimidazoline 1-tallowamidobutyl-2-tallowpiperidine 2-coconutamidomethyl-2-laurylpyrimidine These amines and methods for their preparation are fully described British Application 8508130, filed Mar. 28, 1985 by Koenig and De Buzzacarini (b) Quaternary Ammonium Salt The softener active system can further comprise a conventional di(higher alkyl) quaternary ammonium softening agent. By "higher alkyl" as used in the context of the quaternary ammonium salts herein is meant alkyl groups having from 8 to 30 carbon atoms, preferably from 11 to 22 carbon atoms. Examples of such conventional quaternary ammonium salts include (i) acyclic quaternary ammonium salts having the formula: Formula (II)

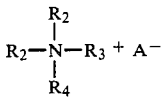

wherein $R_2$ is an acyclic aliphatic $C_{15}$–$C_{22}$ hydrocarbon group. $R_3$ is a $C_1$–$C_4$ saturated alkyl or hydroxyalkyl group, $R_4$ is selected from $R_2$ and $R_3$ and A is an anion.

Examples of acyclic quaternary ammonium salts are the wellknown dialkyldimethylammonium salts such as ditallowdimethylammonium chloride, ditallowdimethylammonium methylsulfate, di(hydrogenated tallow) dimethylammonium chloride, dibehenyldimethylammonium chloride.

(ii) diamido quaternary ammonium salts having the formula:

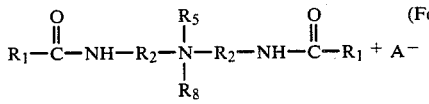

(Formula III)

wherein $R_1$ is an acyclic aliphatic $C_{15}$–$C_{22}$ hydrocarbon group. $R_2$ is a divalent alkylene group having 1 to 3 carbon atoms, $R_5$ and $R_8$ are $C_1$–$C_4$ saturated alkyl or hydroxyalkyl groups, and A is an anion.

Examples of diamide quaternary ammonium salts are methylbis(tallowamidoethyl) (2-hydroxyethyl) ammonium methylsulfate and methylbis(hydrogenated tallowamidoethyl) (2-hydroxyethyl) ammonium methylsulfate, wherein $R_1$ is an acyclic aliphatic $C_{15}$–$C_{17}$ hydrocarbon group, $R_2$ is an ethylene group, $R_5$ is a methyl group, $R_8$ is a hydroxyalkyl group and A is a methylsulfate anion; these materials are available from Sherex Chemical Company under the trade names Varisoft ®222 and Varisoft ®220, respectively.

(iii) diamide alkoxylated quaternary ammonium salts having the formula:

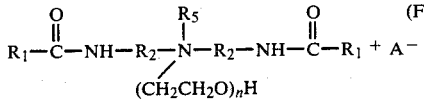

(Formula IV)

wherein n is an integer from 1 to 5, and $R_1$, $R_2$, $R_5$ and $A^-$ are as defined above.

(iv) quaternary imidazolinium compounds such as 1-methyl-1-tallowamido-ethyl-2-tallowimidazolinium methylsulfate and 1-methyl-1-(hydrogenated tallowamidoethyl)-methylsulfate.

The quaternary ammonium salt (b) preferably comprises from 10% to 50%, more preferably from 20% to 40% of the softener active system.

(c) Optional Silicone Component

The fabric softening active system optionally contains an aqueous emulsion of a predominantly linear polydialkyl or alkyl, aryl siloxane in which the alkyl groups can have from one to five carbon atoms and may be wholly or partially fluorinated. Suitable silicones are polydimethyl siloxanes having a viscosity at 25° C. in the range from 100 to 100,000 centistokes, preferably in the range from 1000 to 12,000 centistokes.

It has been found that the ionic charge characteristics of the silicone as used in the combination are important in determining both the extent of deposition and the evenness of distribution of the silicone and hence the properties of a fabric treated therewith.

Silicones having cationic character show an enhanced tendency to deposit. Silicones found to be of value in providing fabric feel benefits have a predominantly linear character and are preferably polydialkyl siloxanes in which the alkyl group is most commonly methyl. Such silicone polymers are frequently manufactured commercially by emulsion polymerization using a strong acid or strong alkali catalyst in the presence of a nonionic or mixed nonionic-anionic emulsifier system.

In the present invention, the optional silicone component embraces a silicone of cationic character which is defined as being one of (a) a predominantly linear di $C_1$–$C_5$ alkyl or $C_1$-alkyl, aryl siloxane, prepared by emulsion polymerization using a cationic surfactant as emulsifier;

(b) an alpha-omega-di quaternized di($C_1$–$C_5$) alkyl or $C_1$–$C_5$ alkyl, aryl siloxane polymer or (c) an amino-functional di $C_1$–$C_5$ alkyl or alkyl aryl siloxane polymer in which the amino group may be substituted and may be quaternized and in which the degree of substitution (d.s.) lies in the range 0.0001 to 0.1, preferably 0.01–0.075. provided that the viscosity at 25° C. of the silicone is from 100 to 100,000 cs.

B. The Soil Release Agent

Polymeric soil release agents useful in the present invention include cellulosic derivatives such as hydroxyether cellulosic polymers, copolymeric blocks of ethylene terephthalate and polyethylene oxide or polypropylene oxide terephthalate, and cationic guar gums, and the like.

The cellulosic derivatives that are functional as soil release agents are commercially available and include hydroxyethers of cellulose such as Methocel ® (Dow) and cationic cellulose ether derivatives such as Polymer JR-124 ®, JR-400 ®, and JR-30M ® (Union Carbide). See also U.S. Pat. 3,928,213 to Temple et al, issued Dec. 23, 1975, which is incorporated by reference.

Other effective soil release agents are cationic guar gums such as Jaguar Plus ® (Stain Hall) and Gendrive 458 ® (General Mills).

Preferred cellulosic soil release agents for use herein are selected from the group consisting of methyl cellulose; hydroxypropyl methylcellulose; hydroxybutyl methylcellulose; or a mixture thereof, said cellulosic polymer having a viscosity in aqueous solution at 20° C. of 15 to 75,000 centipoise.

A more preferred soil release agent is a copolymer having random blocks of ethylene terephthalate and polyethylene oxide (PEO) terephthalate. More specifically, these polymers are comprised of repeating units of ethylene terephthalate and PEO terephthalate in a mole ratio of ethylene terephthalate units to PEO terephthalate units of from about 25:75 to about 35:65, said PEO terephthalate units containing polyethylene oxide having molecular weights of from about 300 to about 2000. The molecular weight of this polymeric soil release agent is in the range of from about 25,000 to about 55,000. See U.S. Pat. No. 3,959,230 to Hays, issued May 25, 1976, which is incorporated by reference. See also U.S. Pat. No. 3,893,929 to Basadur issued July 8, 1975 (incorporated by reference) which discloses similar copolymers.

Another preferred polymeric soil release agent is a crystallizable polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000, and the mole ratio of ethylene terephthalate units to polyoxyethylene terephthalate units in the crystallizable polymeric compound is between 2:1 and 6:1. Examples of this polymer include the commercially available material Zelcon ®5126 (from Dupont) and Milease ®T (from ICI).

Highly preferred soil release agents are compounds of formula:

$$X-(OCH_2CH_2)_n(OR^5)_m][(A-R^1-A-R^2)_u(A-R^3-A-R^2)_v-A-R^4-A-(R^5O)_m(CH_2CH_2O)_n-X \quad \text{(Formula V)}$$

wherein the A moieties are essentially $$-\overset{O}{\overset{\|}{C}}O- \text{ or } -\overset{O}{\overset{\|}{C}}O-$$

moieties; the $R^1$ moieties are essentially 1,4-phenylene moieties; the $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarbylene moieties having at least one $-O-(R^5O)_m(CH_2CH_2O)_n-X$ or $-A-(R^2-A-R^4-A)]_w[(R^5O)_m(CH_2CH_2O)_n-X$ substituent or at least one moiety $-A-(R^2-A-R^4-A)-_wR^2-A-$ crosslinked to another $R^3$ moiety; the $R^4$ moieties are $R^1$ or $R^3$ moieties, or a mixture thereof; each $R^5$ is $C_3$–$C_4$ alkylene, or the moiety $-R^2-A-R^6-$, where $R^6$ is a $C_1$–$C_{12}$ alkylene, alkenylene, arylene or alkarylene moiety; each M is H or a water-soluble cation; each X is H, $C_1$–$C_4$ alkyl or $$-\overset{O}{\overset{\|}{C}}R^7,$$

wherein $R^7$ is $C_1$–$C_4$ alkyl; m and n are numbers such that the moiety $-(CH_2CH_2O)-$ comprises at least about 50% by weight of the moiety $-(R^5O)_m(CH_2CH_2O)_n-$, provided that when $R^5$ is the moiety $-R^2-A-R^6-$, m is 1; each n is at least about 6; u and v are numbers such that the sum of u+v is from about 3 to about 25; w is 0 or at least 1; and when w is at least 1, u, v and w are numbers such that the sum of u+v+w is from about 3 to about 25.

Preferred compounds of Formula V are block polyesters having the formula:

$$X-(OCH_2CH_2)_n\left[(\overset{O}{\overset{\|}{C}}O-R^1-\overset{O}{\overset{\|}{C}}O-R^2)_u(-\overset{O}{\overset{\|}{C}}O-R^3-\overset{O}{\overset{\|}{C}}O-R^2)_v\right]\overset{O}{\overset{\|}{C}}O-R^4-\overset{O}{\overset{\|}{C}}O-(CH_2CH_2O)_n-X$$

wherein the $R^1$ moieties are all 1,4-phenylene moieties; the $R^2$ moieties are essentially ethylene moieties, 1,2-propylene moieties or mixtures thereof; the $R^3$ moieties are substituted 1,3-phenylene moieties having the substituent $$-\overset{O}{\overset{\|}{C}}O\left[(R^2-\overset{O}{\overset{\|}{C}}O-R^4-\overset{O}{\overset{\|}{C}}O)\right]_w(CH_2CH_2O)_n-X$$

at the 5 position; the $R^4$ moieties are $R^1$ or $R^3$ moieties, or mixtures thereof; each X is ethyl or preferably methyl; each n is from about 12 to about 43; when w is 0, u+v is from about 3 to about 10; when w is at least 1, u+v+w is from about 3 to about 10.

Particularly preferred block polyesters are those where v is 0, i.e. the linear block polyesters. For these most preferred linear block polyesters, u typically ranges from about 3 to about 8, especially for those made from dimethyl terephthalate, ethylene glycol (or 1,2-propylene glycol) and methyl capped polyethylene glycol. The most water soluble of these linear block polyesters are those where u is from about 3 to about 5.

The compounds of Formula V can be prepared by art-recognized methods. Although the following synthesis description is for the preferred block polyesters, other versions can be prepared by appropriate variation.

The block polyesters are typically formed from: (1) ethylene glycol, 1,2-propylene glycol or a mixture thereof; (2) a polyethylene glycol (PEG) capped at one end with a $C_1$–$C_4$ alkyl group; (3) a dicarboxylic acid (or its diester); and optionally (4) a polycarboxylic acid (or its ester) for branched polyesters. The respective amounts of these four components are selected to prepare polyesters having the desired properties in terms of solubility and soil release properties.

The crude polyester compositions obtained from the above syntheses often contain block polyesters having varying backbone lengths. The shorter backbone length polyesters are more soluble but have less soil release activity. The longer backbone length polyesters have greater soil release activity but are less soluble. To obtain the more soluble, more active block polyesters, the crude composition can be fractionated with alcohol(s). For example, a crude polyester composition prepared with ethylene glycol can be successively extracted with 2-propanol, ethanol and methanol to obtain a methanol soluble fraction containing more of the soluble, active block polyesters. For those crude polyester compositions prepared with 1,2-propylene glycol, extraction with essentially anhydrous ethanol at low temperatures, e.g., from about 10° to 15° C. provides an ethanol soluble fraction having more of the soluble, active block polyesters. The foregoing polymers and methods of their preparation are more fully described in U.S. patent application Ser. No. 684,511, filed Dec. 21, 1984, by Eugene P. Gosselink, which is incorporated herein by reference.

While not preferred for purposes of this invention, effective fabric softening compositions can be formulated without the di(higher alkyl) cyclic amines by combining fabric softening actives such as those of Formula II with the soil release agents of Formula V. Indeed, when used with rinse-added fabric softener actives of Formula II, certain of the agents of Formula V, in particular those where $R^2$ is 1,2-propylene and n is about 16, impart improved soil release performance to fabrics previously washed with liquid laundry products. In addition, when used with softener actives of Formula II, certain of the agents of Formula V, in particular those where $R^2$ is 1,2-propylene and n is about 43, impart improved soil release performance to fabrics previously washed with granular laundry products, especially granular products containing a high level of anionic detergent surfactant.

C. Optional Ingredients

(a) Bronstedt Acid

As disclosed hereinabove, the pH of the composition is important for proper dispersion of the amine. Moreover, a moderately acidic pH is important for hydrolytic stability of polyester-type soil release agents, therefore, the composition preferably comprises a Bronstedt acid having a pKa value of 6 or less.

The amount of acid should be such that the pH of the dispersion, after mixing, is in the range from 2 to 8, preferably not greater than 6, and most preferably in the range of from 3–5. Typically, the amount of acid is from 1% to 30% by weight of the amine, preferably from 2% to 30%, most preferably from 3 to 15%.

Examples of suitable acids include the inorganic mineral acids, carboxylic acids, in particular the low molecular weight ($C_1$–$C_5$) carboxylic acids, and alkylsulfonic acids.

Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, formic and methylsulfonic acid.

(b) Organic Solvent

The compositions of the present invention can be formulated without the use of any organic solvent. However, the presence of organic solvents (for example, low molecular weight, water miscible aliphatic alcohols,) does not harm the storage stability, the viscosity, or the softening performance of the compositions of this invention.

Typically, the amine and the (optional) quaternary ammonium salt will be obtained from a supplier of bulk chemicals in solid form or as a solution in an organic solvent, e.g., isopropanol. There is no need, whatsoever, to remove such a solvent in making the compositions of this invention. Indeed, additional solvent may be added, if this is deemed desirable.

(c) Optional Nonionics

The compositions optionally contain nonionics as have been disclosed for use in softener compositions. Such nonionics and their usage levels, have been disclosed in U.S. Pat. No. 4,454,049, issued June 12, 1984 to Mac Gilip et al, the disclosures of which are incorporated herein by reference.

Specific examples of nonionics suitable for the compositions herein include glycerol esters (e.g., glycerol monostearate), fatty alcohols (e.g., stearyl alcohol), and alkoxylated fatty alcohols. The nonionic, if used, is typically used at a level in the range of from 0.5–10% by weight of the composition.

Although generally considered as having fabric softening properties, the nonionics are not considered part of the fabric softening active system for the purposes of calculating the amount of fabric softening active system in the composition or of calculating the amount of soil release agent.

(d) Optional Silicone Component

The fabric softening composition optionally contains an aqueous emulsion of a predominantly linear polydialkyl or alkyl aryl siloxane in which the alkyl groups can have from one to five carbon atoms and may be wholly or partially fluorinated. Suitable silicones are polydimethyl siloxanes having a viscosity at 25° C. in the range from 100 to 100,000 centistokes, preferably in the range from 1000 to 12,000 centistokes.

It has been found that the ionic charge characteristics of the silicone as used in the combination are important in determining both the extent of deposition and the evenness of distribution of the silicone and hence the properties of a fabric treated therewith.

Silicones having cationic character show an enhanced tendency to deposit. Silicones found to be of value in providing fabric feel benefits have a predominantly linear character and are preferably polydialkyl siloxanes in which the alkyl group is most commonly methyl. Such silicone polymers are frequently manufactured commercially by emulsion polymerization using a strong acid or strong alkali catalyst in the presence of a nonionic or mixed nonionic-anionic emulsifier system.

In the present invention, the optional silicone component embraces a silicone of cationic character which is defined as being one of (a) a predominantly linear di $C_1$–$C_5$ alkyl or $C_1$-alkyl, aryl siloxane, prepared by emulsion polymerization using a cationic surfactant as emulsifier;

(b) an alpha-omega-di quaternized di $C_1$–$C_5$ alkyl or $C_{1-C5}$ alkyl, aryl siloxane polymer or (c) an amino-functional di $C_1$–$C_5$ alkyl or alkyl aryl siloxane polymer in which the amino group may be substituted and may be quaternized and in which the degree of substitution (d.s.) lies in the range 0.0001 to 0.1, preferably 01–0.073.

provided that the viscosity at 25° C. of the silicone is from 100 to 100,000 cs.

The fabric softening compositions herein may contain up to 10%, preferably from 0.1% to 5% of the silicone component.

(a) Other Optional Ingredients

In order to further improve the stability of the compositions herein, and further adjust their viscosities, these compositions can contain relatively small amounts of electrolyte. A highly preferred electrolyte is $CaCl_2$.

The compositions herein can optionally contain other ingredients known to be suitable for use in textile softeners. Such adjuvents include perfumes, preservatives, germicides, colorants, dyes, fungicides, stabilizers, brighteners and opacifiers. These adjuvents, if used, are normally added at their conventional levels. However, in the case of composition ingredients utilized for a fabric treatment effect, e.g., perfumes, these materials can be added at higher than normal levels, corresponding to the degree of concentration of the product.

EXAMPLE I

Fabric softener base compositions are prepared as follows:

| | A | B | C | D | E |
|---|---|---|---|---|---|
| DTDMAC[1] | 2.33 | 1.17 | 7.0 | 3.5 | 1.5 |
| Amine[2] | 4.33 | 2.17 | 13.0 | 6.5 | 2.4 |
| PDMS[3] | 1.33 | 0.67 | 4.0 | 2.0 | 1.0 |
| Perfume | 0.25 | 0.25 | 0.75 | 0.75 | 0.4 |
| Minors[4] | 0.13 | 0.13 | 0.4 | 0.4 | 0.2 |
| HCl | | | to pH 4 | | |
| Water | | | balance | | |

[1]ditallowdimethylammonium chloride
[2]1-tallowamidoethyl-2-tallowimidazoline
[3]polydimethyl siloxane having a viscosity of 5000 centistokes
[4]$CaCl_2$, dye, bactericide To the base compositions, soil release polymers are added as follows:

Composition A+0.5% of Polymer I
Composition B+0.5% of Polymer II
Composition C+0.7% of Polymer IV
Composition D+0.7% of Polymer III
Composition E+0.5% of Polymer II Polymer 1 contains the soil release agent:

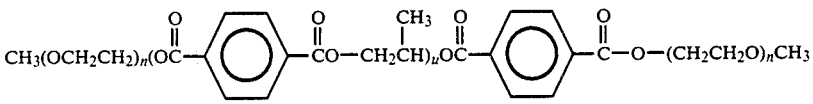

wherein n is about 16 (average) and u is about 3 to about 5; the Molecular Weight of Polymer I is 1800 (average). Polymer II contains the soil release agent:

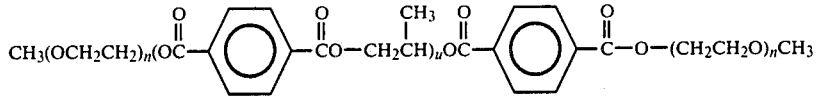

wherein n is about 16 (average) and u is about 3 to about 5; the Molecular Weight of Polymer II is 2000 (average). Polymer III is Methocel ®E15 (Dow), a cellulose polymer substituted with methoxyl (2%–30%) and hydroxypropyl (7–12%); viscosity of a 2% solution 15 CP. Polymer IV is Jaguar Plus ®, a cationic guar gum (Stein Hall). Composition E is modified to increase the concentration of DTDMAC to 3.6% and delete the amine, yielding a fabric softening composition having satisfactory properties.

What is claimed is:

1. An aqueous fabric softener composition comprising:

(A) from 1% to 50% by weight of the composition of a fabric softening active system wherein at least 10% of said active system is selected from the group consisting of di(higher alkyl) cyclic amines having the formula

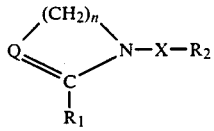

wherein n is 2 or 3, $R_1$ and $R_2$ are each selected from the group consisting of alkyl and alkenyl containing from 8 to 30 carbon atoms and mixtures thereof, Q is CH or N, X is $R_4$ or

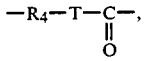

wherein $R_4$ is an alkylene group containing from 1 to 3 carbon atoms or is $(C_2H_4O)_m$, m being an integer from 1 to 8, and T is O or $NR_5$, $R_5$ being H or alkyl having 1 to 4 carbon atoms; and (B) from 3% to 20% by weight of (A) of a soil release agent.

2. The aqueous fabric softening composition of claim 1 wherein the amount of soil release agent is from 5 to 15% by weight of the fabric softening active system.

3. An aqueous fabric softening composition according to claim 2 wherein the soil release agent is a polymer selected from the group consisting of the hydroxyether cellulosic polymers, copolymers of ethylene terephthalate and polyethylene oxide terephthalate, cationic guar gums, and mixtures thereof.

4. A composition according to claim 2 wherein the soil release agent is of formula:

$$X-(OCH_2CH_2)_n(OR^5)_m][(A-R^1-A-R^2)_u(A-R^3-A-R^2)_v-A-R^4-A-(R^5O)_m(CH_2CH_2O)_n-X$$

wherein the A moieties are essentially $$-\overset{O}{\overset{\|}{C}}O- \text{ or } -\overset{O}{\overset{\|}{C}}O-$$

moieties; the $R^1$ moieties are essentially 1,4-phenylene moieties; the $R^2$ moieties are essentially ethylene moieties, or substituted ethylene moieties having $C_1$–$C_4$ alkyl or alkoxy substituents; the $R^3$ moieties are substituted $C_2$–$C_{18}$ hydrocarbylene moieties having at least one $-O-(R^5O)_m(CH_2CH_2O)_n-X$ or $-A-(R^2-A-R^4-A)]_w[(R^5O)_m(CH_2CH_2O)_n]X$ substituent or at least one moiety $-A-(R^2-A-R^4-A)-_wR^2-A-$ cross-linked to another $R^3$ moiety; the $R^4$ moieties are $R^1$ or $R^3$ moieties, or a mixture thereof; each $R^5$ is $C_3$–$C_4$ alkylene, or the moiety $-R^2-A-R^6-$, wherein $R^6$ is a $C_1$–$C_{12}$ alkylene, alkenylene, arylene or alkarylene moiety; each X is H, $C_1$–$C_4$ alkyl or $$-\overset{O}{\overset{\|}{C}}R^7,$$

wherein $R^7$ is $C_1$–$C_4$ alkyl; m and n are numbers such that the moiety $-(CH_2CH_2O)-$ comprises at least about 50% by weight of the moiety $-(R^5O)_m(CH_2CH_2O)_n-$, provided that when $R^5$ is the moiety $-R^2-A-R^6-$, m is 1; each n is at least about 6; u and v are numbers such that the sum of u+v is from about 3 to about 25; w is 0 or at least 1; and when w is at least 1, u, v and w are numbers such that the sum of u+v+w is from about 3 to about 25.

5. A composition according to claim 4 wherein the fabric softening active system comprises, in addition to the di(higher alkyl) cyclic amine, a conventional softening active compound selected from the group of quaternary ammonium salts having at least one acyclic aliphatic $C_{15}$–$C_{22}$ hydrocarbon group.

6. A composition according to claim 5 wherein the quaternary ammonium salt is ditallowdimethylammonium chloride.

7. A composition according to claim 6 wherein the soil release agent is a compound of the formula

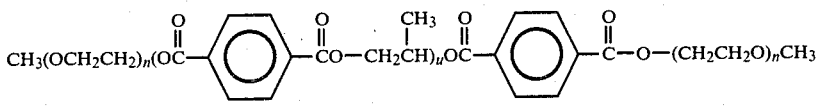

wherein n averages about 16 and u is about 3 to about 5.

8. A composition according to claim 7 wherein the di(higher alkyl) cyclic amine is 1-tallowimidoethyl-2-tallowimidazoline.

9. A composition according to claim 5 wherein the softener active system comprises from 0.1% to 10% of a predominantly linear di($C_1$–$C_5$) alkyl or $C_1$–$C_5$ alkylaryl siloxane in which the alkyl groups are partially or wholly fluorinated and which may be substituted with cationic nitrogen groups, the siloxane having a viscosity at 25° C. of at least 100 centistokes and up to 100,000 centistokes.

10. A composition according to claim 9 wherein the siloxane is a polydimethyl siloxane.

11. A composition according to claim 4 wherein the softener active system comprises: from 25% to 40% by weight of the softener active system of an acyclic quaternary ammonium salt of formula (II) herein; from 50% to 70% of a di(higher alkyl) cyclic amine of formula (I) herein; from 5% to 15% of a polydimethyl siloxane having a viscosity at 25° C. of at least 100 centistokes and up to 100,000 centistokes.

* * * * *

UNITED STATES PATENT AND TRADEMARK OFFICE

CERTIFICATE OF CORRECTION

PATENT NO. : 4,661,267

DATED : April 28, 1987

INVENTOR(S) : Bob Decker, Axel Konig, Theodericus S. Straathof, Eugene P. Gosselink It is certified that error appears in the above-identified patent and that said Letters Patent is hereby corrected as shown below:

Column 3, lines 1-5, "

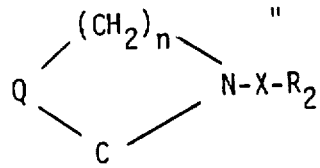

should be --

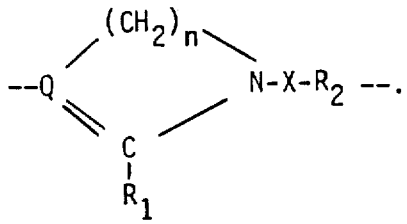

--.

Column 11, lines 1-3, " $X—(OCH_2CH_2)_n(OR^5)_m][(A—R^1—A—R^2)_u(A—R^3—A—R^2)_v—A—R^4—A—(R^5O)_m(CH_2CH_2O)_n—X$"

should read -- $X \vdash (OCH_2CH_2)_n(OR^5)_m \dashv \vdash (A-R^1-A-R^2)_u(A-R^3-A-R^2)_v \dashv -A-R^4-A \vdash (R^5O)_m(CH_2CH_2O)_n \dashv X$ --.

UNITED STATES PATENT AND TRADEMARK OFFICE

CERTIFICATE OF CORRECTION

PATENT NO. : 4,661,267

DATED : April 28, 1987

INVENTOR(S) : Bob Decker, Axel Konig, Theodericus S. Straathof, Eugene P. Gosselink It is certified that error appears in the above-identified patent and that said Letters Patent is hereby corrected as shown below:

Column 11, lines 22-25, "eties having at least one $—O—(R^5O)_m(CH_2CH_2O)_n—X$ or $—A—(R^2—A—R^4—A)]_w[(R^5O)_m(CH_2CH_2O)_n]X$ substituent or at least one moiety $—A—(R^2—A—R^4—A)—_wR^2—A—$ cross- "

should read --eties having at least one $-O\text{-}(R^5O)_m(CH_2CH_2O)_n\text{-}X$ or $-A\text{-}(R^2\text{-}A\text{-}R^4\text{-}A)\text{-}_w\text{-}(R^5O)_m(CH_2CH_2O)_n\text{-}X$ substituent or at least one moiety $-A\text{-}(R^2\text{-}A\text{-}R^4\text{-}A)\text{-}_wR^2\text{-}A\text{-}$ cross- --.

Column 11, lines 39-40, " least about 50% by weight of the moiety $—(R^5O)_m(CH_2CH_2O)_n—$, provided that when $R^5$ is the"

should read --least about 50% by weight of the moiety $\text{-}(R^5O)_m(CH_2CH_2O)_n\text{-}$, provided that when $R^5$ is the--.

Signed and Sealed this

Eighth Day of August, 1989

*Attest:*

*Attesting Officer*

DONALD J. QUIGG

*Commissioner of Patents and Trademarks*